US007627933B2

(12) United States Patent
Drapela et al.

(10) Patent No.: US 7,627,933 B2
(45) Date of Patent: Dec. 8, 2009

(54) FORMING HEAD WITH FEATURES TO PRODUCE A UNIFORM WEB OF FIBERS

(75) Inventors: David Drapela, Pittsburg, PA (US); William R. Sellars, Milwaukee, WI (US)

(73) Assignee: Sellars Absorbent Materials, Inc., Milwaukee, WI (US)

( * ) Notice: Subject to any disclaimer, the term of this patent is extended or adjusted under 35 U.S.C. 154(b) by 764 days.

(21) Appl. No.: 11/296,125

(22) Filed: Dec. 7, 2005

(65) Prior Publication Data

US 2007/0124894 A1 Jun. 7, 2007

(51) Int. Cl.
*D01G 25/00* (2006.01)

(52) U.S. Cl. ..... 19/296; 19/304; 19/308

(58) Field of Classification Search ..... 19/296, 19/304–308
See application file for complete search history.

(56) References Cited

U.S. PATENT DOCUMENTS

| | | | |
|---|---|---|---|
| 3,252,186 | A | 5/1966 | Oja |
| 3,508,301 | A | 4/1970 | Brown |
| 3,914,822 | A | 10/1975 | Wood |
| 3,918,126 | A | 11/1975 | Wood |
| 3,972,092 | A | 8/1976 | Wood |
| 4,102,963 | A | 7/1978 | Wood |
| 4,112,549 | A | 9/1978 | Min et al. |
| 4,240,180 | A | 12/1980 | Wood et al. |
| 4,264,289 | A | 4/1981 | Day |
| 4,278,113 | A | 7/1981 | Persson |
| 4,351,793 | A | 9/1982 | Day |
| 4,352,649 | A | 10/1982 | Jacobsen et al. |
| 4,403,374 | A | 9/1983 | Wood |
| 4,404,710 | A | 9/1983 | Wood |
| RE31,775 | E | 12/1984 | Persson |
| 4,640,810 | A | 2/1987 | Laursen et al. |
| 4,847,022 | A | 7/1989 | Bold |
| 5,445,777 | A | 8/1995 | Noel et al. |

(Continued)

FOREIGN PATENT DOCUMENTS

| | | |
|---|---|---|
| WO | WO 03/016605 | 2/2003 |

(Continued)

OTHER PUBLICATIONS

PCT/US06/46537 International Search Report and Written Opinion, Dated Dec. 5, 2008.

*Primary Examiner*—Shaun R Hurley
(74) *Attorney, Agent, or Firm*—Michael Best & Friedrich LLP

(57) ABSTRACT

A method and device for depositing fibers on a forming wire. In one embodiment, a device includes a fiber reservoir having an inlet, a first outlet configured to pass air or gas, and a second outlet configured to pass fiber. The device also includes a fiber meter configured to move fiber out of the reservoir to a forming head via mechanical action and along substantially the entire width of the forming head. The forming head includes one or more air inlets and one or more agitators to blend and open the fiber received from the fiber meter. The forming head interfaces with a vacuum source that draws air into the forming head through the air inlets, which can be adjusted to affect volume and velocity of air drawn into the forming head.

33 Claims, 5 Drawing Sheets

U.S. PATENT DOCUMENTS

| | | | | |
|---|---|---|---|---|
| 5,885,516 | A | 3/1999 | Christensen | |
| 6,233,787 | B1 | 5/2001 | Eriksen et al. | |
| 6,263,545 | B1 | 7/2001 | Pinto | |
| 6,276,028 | B1 | 8/2001 | Pinto | |
| 6,421,884 | B2 | 7/2002 | Pinto | |
| 6,460,223 | B1 | 10/2002 | Pinto | |
| 6,557,214 | B2 | 5/2003 | Pinto | |
| 2003/0010683 | A1 | 1/2003 | Christensen | |
| 2003/0070262 | A1 * | 4/2003 | Andersen | 19/296 |
| 2004/0226144 | A1 | 11/2004 | Pinto | |
| 2004/0231108 | A1 | 11/2004 | Thordahl | |
| 2005/0098910 | A1 | 5/2005 | Andersen | |

FOREIGN PATENT DOCUMENTS

| | | |
|---|---|---|
| WO | WO 03/016622 | 2/2003 |
| WO | WO 2004/035919 | 4/2004 |

* cited by examiner

FORMING HEAD WITH FEATURES TO PRODUCE A UNIFORM WEB OF FIBERS

BACKGROUND

Embodiments of the invention relate to forming heads used in manufacturing non-woven materials.

In a typical dry-laid process, fiber material is supplied to an enclosed space (sometimes called a forming box or head) through an air stream. The fiber material is mixed and opened (separated into individual fibers) inside the forming head by means of pin-wheels, agitators, and the like. In many instances, the fiber is then passed through some type of screen before being deposited onto a belt (sometimes called a forming wire), through which a vacuum or suction is usually applied to form a sheet or web of fiber material. The intended use of such a screen is to prevent the passage of unopened lumps of fiber. Unfortunately, a screen also impedes the flow of fiber, thereby requiring considerably more vacuum or suction air than is used with a forming head without a screen. The use of a screen is also disadvantageous because it reduces the productive through-put of a forming head, particularly as attempts are made to process fiber of greater length.

SUMMARY

In addition to problems caused by screens, current processes for forming non-woven materials are not completely satisfactory for other reasons. In many known systems, circular air ducts are used to transport fiber to forming heads. Large volumes of air are required to transport fibers to a forming head in an air stream within such ducting. The circular ducting is sometimes transitioned to rectangular ducting before the air stream reaches the forming head. These transitions are intended to act as flow-spreaders but do not achieve a thoroughly uniform distribution of fiber. The use of other devices such as spouts and nozzles in the fiber-delivery air stream also fail to ensure an even distribution of fiber across the entire width of a forming head. Non-uniform fiber distribution can degrade the uniformity of the produced web, especially cross directionally (across the width of the forming head). Other problems in forming heads are caused, at least in part, by air turbulence, which is introduced as a result of the air stream required to transport fiber to the forming head. This turbulence creates uneven and unpredictable distributions of fiber within the forming head. The large volume of air used to transport fibers may also tend to force fibers through the forming box before they have been sufficiently opened.

Problems with non-uniform fiber distribution are especially problematic when a forming head has no screen, which by impeding the flow of fiber also limits somewhat the extent to which the produced web is affected by the uniformity of the fiber delivery method. Accordingly, there is a need for improved devices and techniques for forming sheets or webs of fiber material with improved uniformity, without the reduced throughput and fiber length limitations resulting from the use of a physical screen barrier.

In one embodiment, the invention provides a device for depositing fibers onto a forming wire or surface located outside of the device (one or more external forming surfaces may be used). The embodiment includes a fiber reservoir having an inlet configured to accept a supply of fiber, possibly in a stream of air or gas (hereafter referred to simply as "air"), a first outlet configured to pass air, and a second outlet configured to pass fiber. (The method of fiber delivery to the reservoir could instead be performed by a belt conveyor or other manner). The embodiment also includes one or more rolls or other devices used to deliver a metered flow of fiber out of the reservoir into a forming head via a mechanical action that is substantially independent of any air stream. The configuration used to deliver fiber from a reservoir to a forming head is hereafter referred to simply as a "fiber meter." A forming head is positioned to receive fiber from the fiber reservoir and includes one or more agitators and one or more air inlets. The forming head is configured to interface with a vacuum source that is used to draw air into the forming head through the one or more air inlets. The one or more air inlets are configured to affect the volume and velocity of air drawn into the forming head, and to thereby affect the flow of fiber through the machine and the action on the fiber by the agitators.

The fiber meter can be configured to deliver a curtain of fiber along substantially the entire width of the forming head. This can be accomplished by ensuring that the width of the forming head, the reservoir, and the fiber meter are substantially the same.

Another embodiment of the invention provides a device for blending and opening fibers. The embodiment includes a first fiber reservoir having an inlet and at least one outlet through which fiber is passed; a first fiber meter positioned adjacent to the at least one outlet of the first fiber reservoir; a second fiber reservoir having an inlet and at least one outlet, the second fiber reservoir positioned adjacent to the first fiber reservoir; and a second fiber meter positioned adjacent to the at least one outlet of the second fiber reservoir. More configurations of fiber reservoirs and meters may be included in the same manner as the first and second described above. A forming head is positioned to receive fiber from the fiber reservoirs. The forming head includes a first retention section; a first angled side wall and a second angled side wall; a funnel section positioned below the first retention section and between the first and second angled side walls; a second retention section positioned below the funnel section; a distribution section positioned below the second retention section; and an outlet or bottom positioned below the distribution section. The bottom is configured to interface with a vacuum source such that an air stream flows from a source (that is substantially independent of any air stream used to provide fibers to the fiber reservoirs) toward the outlet of the forming head.

Another embodiment provides a method of depositing fibers on an external forming wire or wires. The method includes delivering fiber to a fiber reservoir via an air stream; passing air out of the fiber reservoir such that fiber accumulates in the reservoir; moving fiber out of the fiber reservoir substantially via a mechanical action; opening fiber from the reservoir with one or more agitators in a chamber; and applying a vacuum to the chamber to draw air into the chamber. The method also includes affecting the volume and velocity of the air using one or more air inlets in the chamber; and depositing fibers on a forming wire located outside of the chamber.

Other embodiments of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
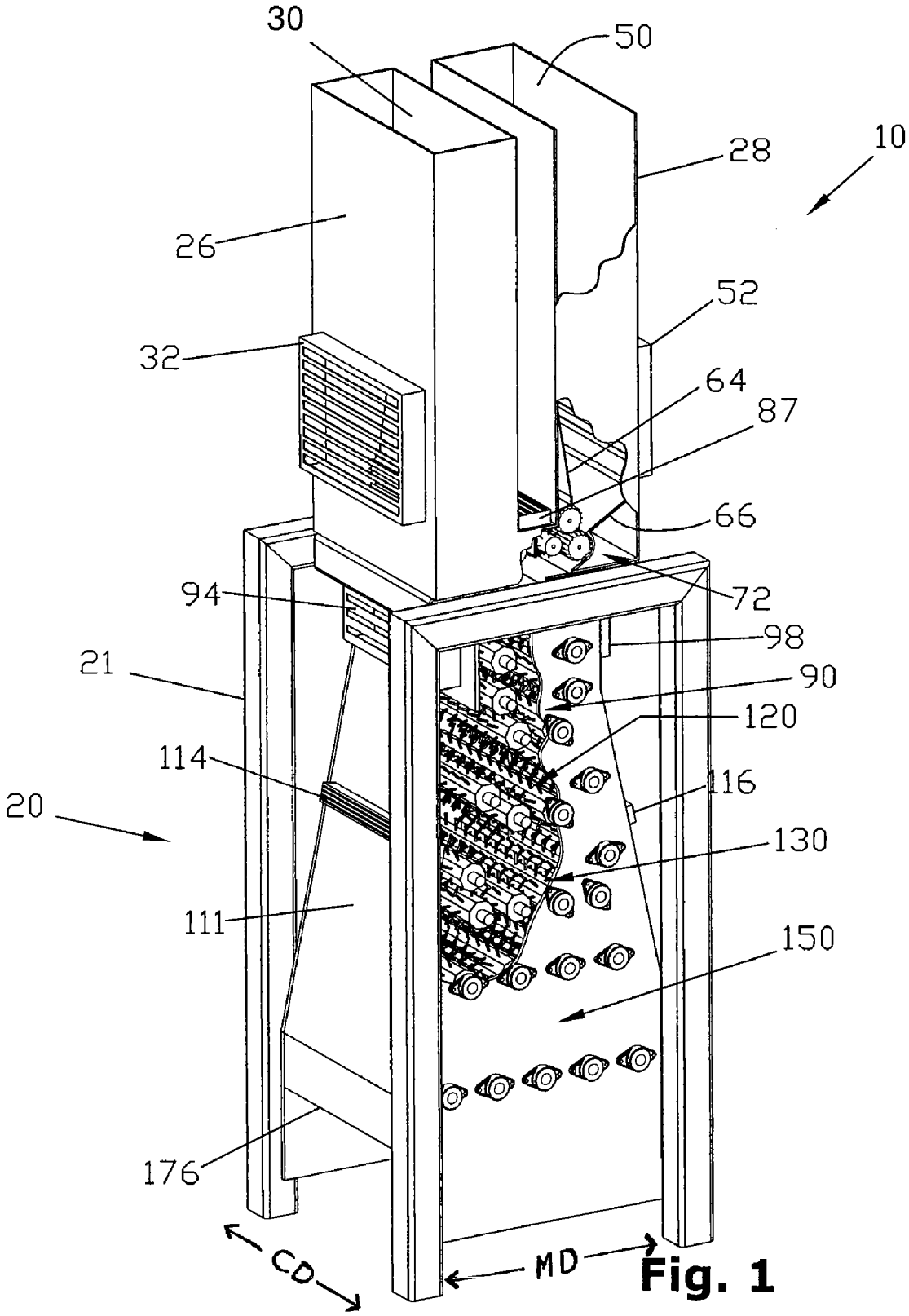
FIG. 1 is a perspective, partially cut-away view of a forming head and associated fiber reservoirs of one embodiment of the invention.
Figure 2:
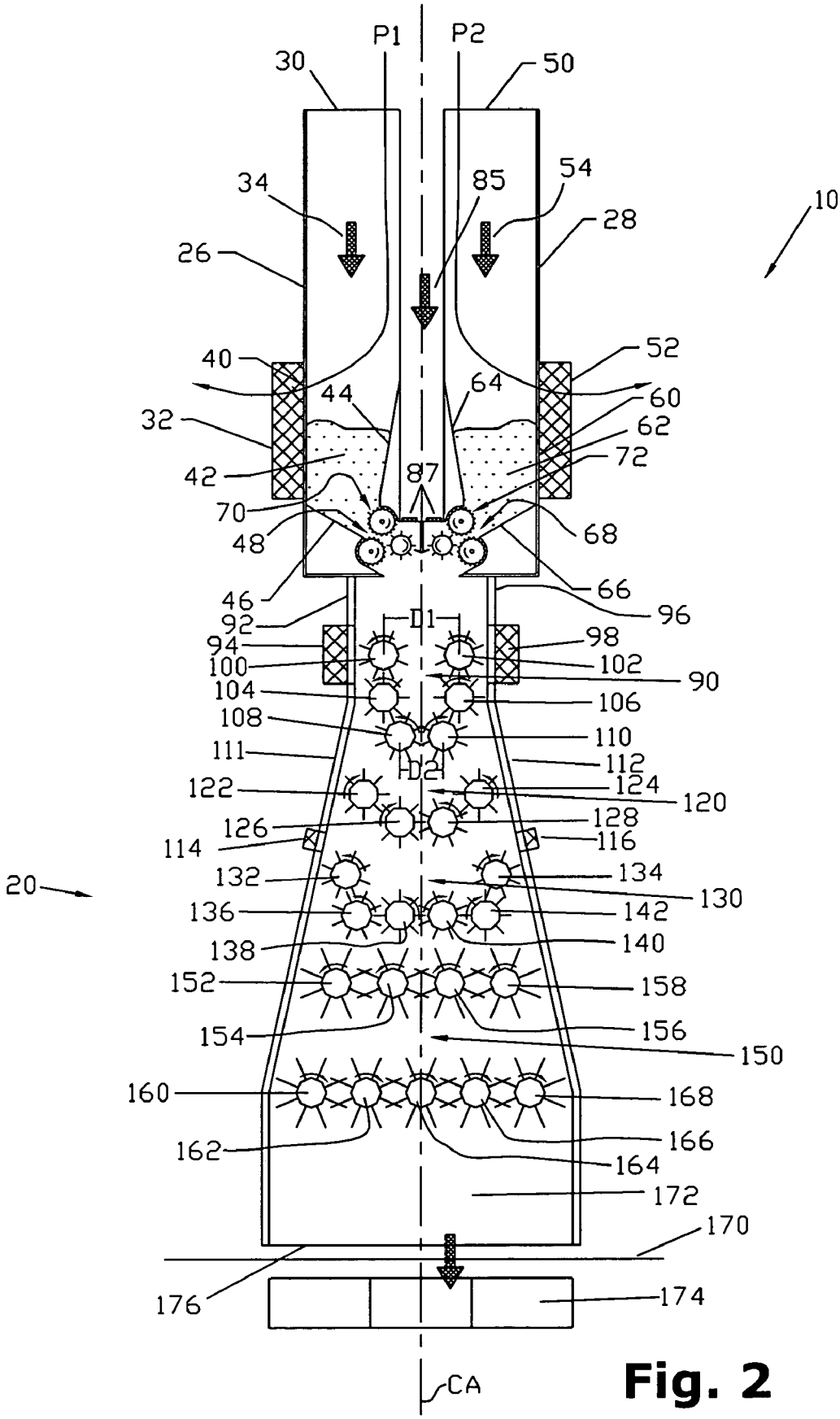
FIG. 2 is a cross-sectional view of the device shown in FIG. 1.
Figure 3:
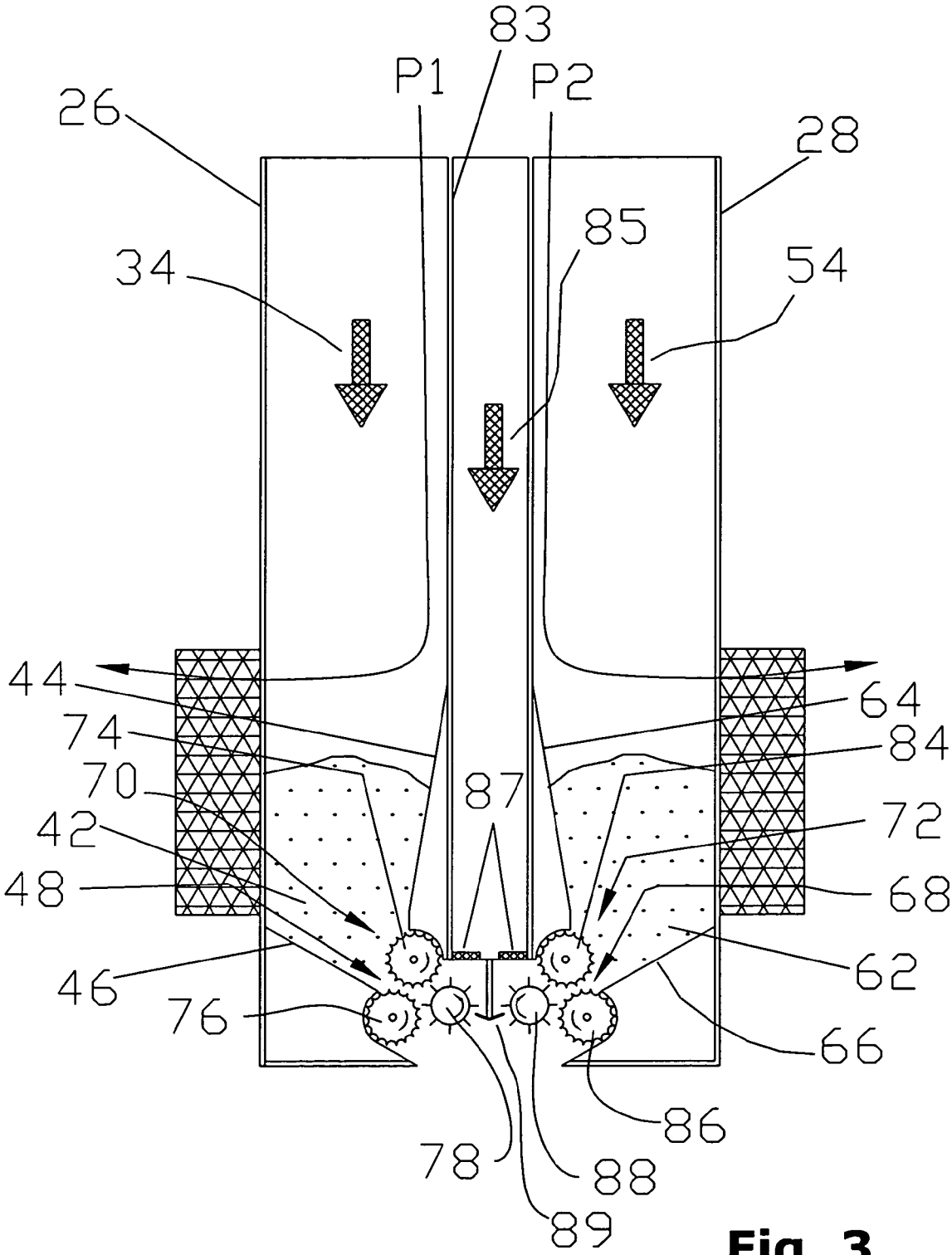
FIG. 3 is an enlarged cross-sectional view of the fiber reservoirs and fiber meters shown in FIG. 2.

FIG. 1 illustrates a device 10 that includes a forming head 20 supported by a frame 21. Positioned above the forming head is a first fiber reservoir 26 and a second fiber reservoir 28 (FIGS. 1, 2, and 3). The first fiber reservoir 26 has an inlet 30 and air vent 32. A first raw material or fibers of a first type (such as cellulose, synthetic fibers, scrap paper, or others) are provided from an external source to the reservoir 26 via an air or gas stream 34. (In the description that follows, the term "air stream" will be used to denote any air, gas, or fluid stream that might be used to transport or move fibers.) The air stream follows a path P1 from the inlet 30 to the vent 32. The vent 32 holds a filter, screen, or similar device 40 that allows air to escape from the reservoir 26, but prevents fibers from doing the same. As a consequence, a quantity of fibers 42 accumulates in or is amassed at the bottom of the reservoir 26. In the embodiment shown, the reservoir 26 includes inclined side walls 44 and 46 to help direct fibers to a fiber outlet 48.

The second fiber reservoir 28 is similar to the first fiber reservoir. The second fiber reservoir 28 includes an inlet 50 and an air vent 52. A second raw material, which is generally but not always different from the first raw material, is provided from an external source to the reservoir 28 via an air stream 54. Fibers such as bi-component or binder fibers may be used as the second raw material. The air stream 54 follows a path P2 from the inlet 50 to the vent 52. The vent 52 holds a filter, screen, or similar device 60 that allows air to escape from the reservoir 28, but prevents fibers from doing the same. As a consequence, a quantity of fibers 62 accumulates in or is amassed at the bottom of the reservoir 28. Angled or inclined side walls 64 and 66 help direct fiber to a fiber outlet 68.

Fiber metering assemblies 70 and 72 (best seen by reference to FIGS. 2 and 3) are positioned adjacent to the outlets 48 and 68, respectively. In the embodiment shown, the metering assembly 70 includes a first metering roll 74 (driven in a counterclockwise direction when viewed from the sectional view in FIG. 2), a second metering roll 76 (driven clockwise), and a brush wheel or pin roll 78 (driven counterclockwise). The metering rolls 74 and 76 are shown as "fluted rolls" (a "flute" being an axially arranged arc or scoop removed from a roll's circumference) but may also have a number of radially extending teeth, tines, pins, or spikes. Fiber 42 is pulled from the reservoir 26 by the mechanical action of the two metering rolls 74 and 76. Specifically, the flutes on the metering rolls mechanically pull fiber from a reservoir outlet, although some pneumatic or vacuum action could be used in conjunction with the mechanical action. Regardless of the exact configuration, it is generally preferable that fiber be supplied to the forming head 20 without requiring the use of an air stream as the main mechanism for delivering fibers to the forming head. The metering rolls 74 and 76 may be driven at a predetermined speed to match the desired amount of fiber to be extracted or obtained from the reservoir 26. The brush roll 78 operates at a higher speed than the metering rolls to assist in the uniform delivery of fiber 42 from the metering rolls 74 and 76 into the forming head 20.

The metering assembly 72 is similar to the metering assembly 70. The metering assembly 72 includes a first metering roll 84 (driven in a clockwise direction when viewed from the sectional view in FIG. 2), a second metering roll 86 (driven counterclockwise), and a brush wheel or brush roll 88 (driven counterclockwise). The operation of the metering assembly is substantially the same as the operation of the metering assembly 70. Therefore, it will not be discussed in further detail. A comb 89 extends between the vents 87 and is positioned between the brush rolls 78 and 88. The width of the comb 89 is substantially similar to the width of the metering assemblies 70 and 72. The purpose of the comb 89 is to prevent the accumulation of fiber on the brush rolls 78 and 88.

Although the metering assemblies 70 and 72 are described in particular, other devices or fiber meters could be used to meter fiber into or deliver the fibers to the forming head 20. For example, it might be possible to form a slit or similar opening in each of the reservoirs 26 and 28 (in place of the outlets 48 and 68) and use a vibrator, pusher paddle, or other device to dispense fiber out of the slit. One desirable characteristic of such devices is that they be able to provide a relatively uniform, cross-directional delivery of fibers.

In one embodiment the outlets 48 and 68 have a width that matches the width of the forming head 20. Generally, the width of the forming head determines the width of the sheet or web of fiber formed. One way of obtaining or enhancing uniform thickness across a web or sheet (such as in a cross direction CD (FIG. 1) and referred to as cross-direction uniformity) is to dispense fibers from the outlets 48 and 68 at a uniform rate across substantially the entire width of the forming head, which can be accomplished by using reservoir outlets and metering rolls that are substantially the same width as the forming head 20. This construction and technique eliminates the need for other complex or unreliable methods of evening out a non-uniform distribution of fiber in a forming head, or otherwise masking its detrimental effects, as is typically necessary when fiber is delivered in an air stream.

In some embodiments, an air duct 83 (FIG. 3) is positioned between the first reservoir 26 and the second reservoir 28. The air duct 83 provides an air stream 85 that is independent of the air streams 34 and 54, in the sense that the air steam 85 is not used to deliver fibers to the forming head 20 or the reservoirs 26 and 28. Air travels through the air duct 83 to the one or more vents 87. In some embodiments, there is no air duct, but vents 87 are still used. The vents 87 can include screens, filters, or louvers to control the volume and velocity of incoming air.

Figure 4:
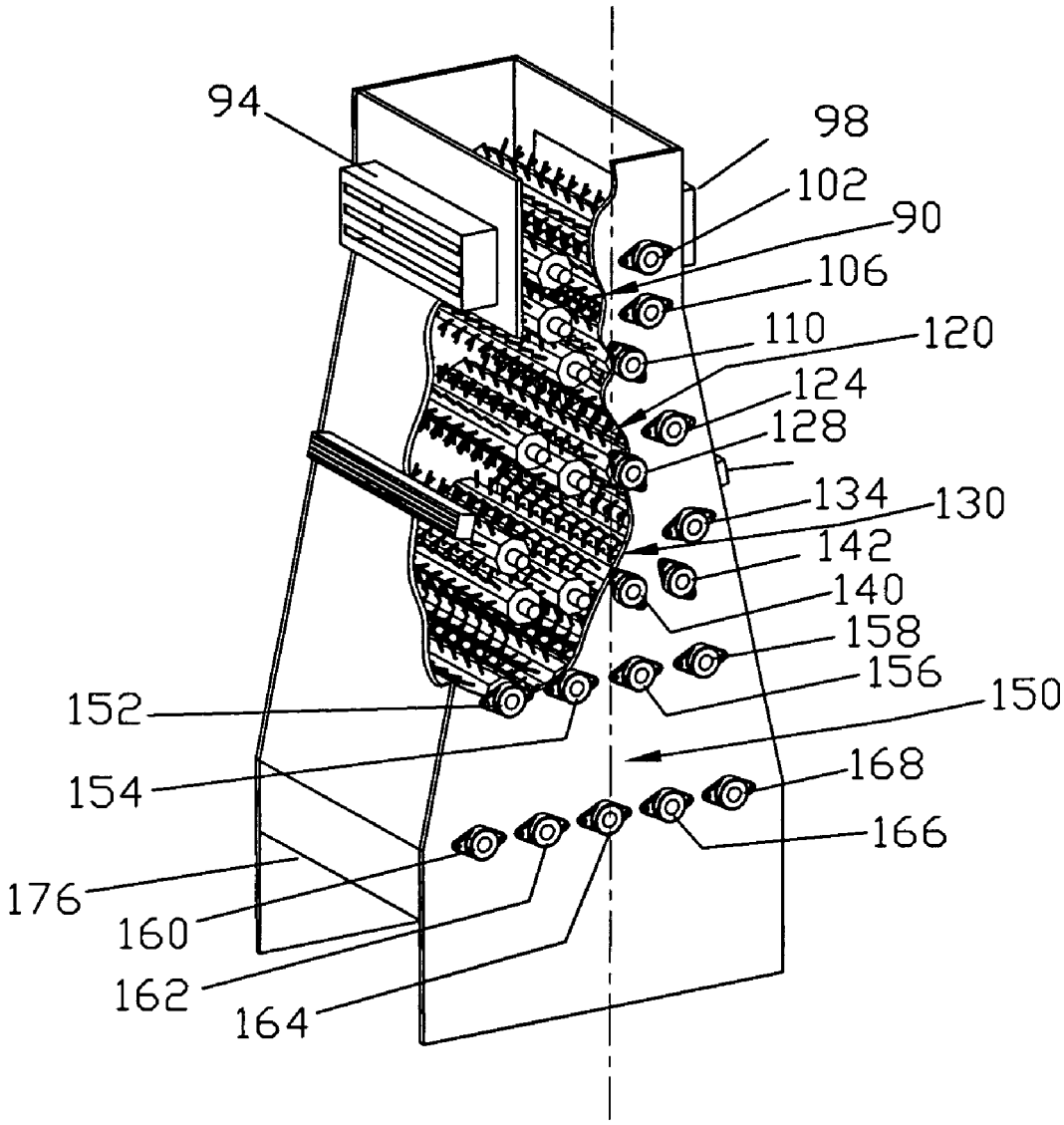
FIG. 4 is an enlarged, perspective view of the forming head shown in FIG. 1.

A retention section 90 (best seen by reference to FIGS. 2 and 4) of the forming head 20 is positioned below the metering assemblies 70 and 72, and is the area or portion of the forming head into which fibers are first introduced. In operation, a moderate negative pressure exists in the retention section 90 generally due to the action of an external vacuum source drawing air into the forming head. In the embodiment shown, the retention section 90 includes a first side wall 92 having a louver or vent 94 and a second side wall 96 having a louver or vent 98.

As shown, the retention section 90 also includes a first agitator 100 (such as a pin wheel, spike roll, or the like) that is driven in a counter-clockwise direction and a second agitator 102 (driven clockwise). In the embodiment shown, the agitators 100 and 102 are positioned a distance D1 (FIG. 2)

from each other and such that their longitudinal axes are substantially parallel to each other and located in a horizontal plane. A third agitator 104 (driven counterclockwise) and a fourth agitator 106 (driven clockwise) are positioned below the first and second agitators 100 and 102, respectively. Two additional agitators 108 and 110 are located in the retention section 90, below the agitators 104 and 106. The agitators 108 and 110 are located closer to a center axis CA (FIG. 2) of the forming head 20 than the agitators 100, 102, 104 and 106. As a consequence, the agitators 108 and 110 are spaced a distance D2 (FIG. 2) from each other that is smaller than the distance D1.

The agitators in the retention section 90 are driven such that they tend to throw fiber back up toward the metering assemblies 70 and 72 to impede the direct downward passage of fiber into the remainder of the forming head 20. This impedance to downward flow provides more opportunity for the agitators to act on and open the fiber fed into them by the metering rolls. These agitators also tend to direct fibers toward the side walls or perimeter of the forming head 20. Air introduced through the vents 94 and 98 generates an air stream that tends to blow the fiber away from the walls 92 and 96 and back into the retention section 90, further retaining or delaying the downward motion of the fibers and providing more time for the agitators to act on the fiber.

In the illustrated embodiment, the forming head 20 includes a first angled side wall 111 and a second angled side wall 112 extending from walls 92 and 96, respectively. The side walls 111 and 112 also include a third vent 114 and a fourth vent 116. The third and fourth vents 114 and 116 are similar to vents 94 and 98, thus vents 114 and 116 need no further description. The use of angled side walls helps ensure that fibers do not pass through the forming head without being acted on by the agitators (particularly those that are located below the retention section 90). When the walls are angled (such as at an angle of about 15°), the agitators may be positioned in a pyramid-fashion such that lower rows of agitators extend beyond the width of prior, higher rows of agitators. This helps prevent fibers from dropping straight through the forming head without being opened. While angled side walls are beneficial, they are not required in all embodiments.

A funnel section 120 of the forming head 20 is positioned between the angled walls 111 and 112 and below the first retention section 90. In the illustrated embodiment, the funnel section 120 includes a seventh agitator 122 that is driven in a clockwise direction and an eighth agitator 124 driven in a counter-clockwise direction. The funnel section also includes a ninth agitator 126 driven in a clockwise direction and a tenth agitator 128 driven in a counter-clockwise direction. The ninth and tenth agitators 126 and 128 are positioned below the seventh and eighth agitators 122 and 124. The longitudinal axes of the ninth and tenth agitators 126 and 128 are substantially parallel and in a horizontal plane. The longitudinal axes of the ninth and tenth agitators 126 and 128 are also substantially parallel and in a horizontal plane. Agitators 126 and 128 are closer to the central axis CA than agitators 122 and 124. The manner in which the agitators are driven in the funnel section 120 tends to direct fibers toward the center or center axis CA of the forming head 20 and down to a second retention section 130.

The second retention section 130 is positioned between the angled walls 111 and 112 and below the funnel section 120. The second retention section 130 includes an eleventh agitator 132 that is driven in a counter-clockwise direction and a twelfth agitator 134 driven in a clockwise direction. In the illustrated embodiment, the agitators 132 and 134 are positioned such that their longitudinal axes are substantially parallel to each other and in a horizontal plane. Thirteenth, fourteenth, fifteenth, and sixteenth agitators 136, 138, 140, and 142 are positioned below the eleventh and twelfth agitators 132 and 134, such that their longitudinal axes are substantially parallel to each other and in a horizontal plane. Agitators 136 and 138 are driven in a counter-clockwise direction, and agitators 140 and 142 are driven in a clockwise direction. Agitators 138 and 140 are located closer to the center axis CA of the forming head 20 than agitators 136 and 142. Like the retention section 90, the manner in which the agitators are driven in the retention section 130 tends to impede the direct downward movement of fiber while also directing fibers toward the side walls or perimeter of the forming head 20. Air introduced through the vents 114 and 116 generates air streams that tend to blow the fiber away from the angled walls 111 and 112 and back into the retention section 130, further retaining or delaying the downward motion of the fibers and providing more time for the agitators to act on the fiber.

A distribution section 150 is positioned between the angled walls 111 and 112 and below the second retention section 130. The distribution section includes agitators 152, 154, 156, and 158, which are positioned such that the longitudinal axes are parallel to each other and in a horizontal plane. Agitators 154 and 156 are closer to the center axis CA than agitators 152 and 158. The agitators 152, 154, 156, and 158 may be driven in either a counter-clockwise or clockwise direction, mainly for the purpose of spreading or distributing the fibers exiting the second retention section 130. The distribution section also includes agitators 160, 162, 164, 166, and 168 positioned below agitators 152, 154, 156, and 158. Agitators 160, 162, 164, 166, and 168 are positioned such that their longitudinal axes are parallel to each other and in a horizontal plane. The agitators 160-168 are typically driven in a direction opposite to the direction of the rotation of the agitators 152-158. However, the directions in which the agitators are driven as described above are exemplary. Modifications of the drive directions are possible. In the configuration shown, the distribution section 150 helps to evenly distribute the fiber along the machine direction (direction MD, shown in FIG. 1).

In general, fiber is provided into the forming head 20 by the metering assemblies 70 and 72. The fiber is then initially blended and opened by the retention section 90. Additional blending and opening occurs in the funnel section 120, the second retention section 130, and the distribution section 150. The sections of the forming head 20 help break the lumps of fiber and evenly distribute the fiber on a surface or forming wire 170 located outside the forming head 20. The forming wire 170 may be a belt, a screen, a sieve-type body, or any suitable device operable to allow a suction air stream or vacuum 172 generated by a vacuum box or device 174 to pass therethrough and to retain the fibers expelled from the forming head 20. The fibers are expelled from the forming head 20 by action of the suction air stream 172 produced by the device 174. In the embodiment shown, the device 174 is positioned below the forming head 20.

In the illustrated embodiment, the forming head 20 defines an enclosed space having vents (or inlets) 87, 94, 98, 114, and 116, and a fiber exit opening or bottom 176. The suction air stream 172 causes a flow of air through the vents 87, 94, 98, 114, and 116, into the forming box 20, and out of the bottom 176. In some embodiments, it is possible to adjust the force or intensity of the suction air stream 172 (by adjusting the device 174). In addition, the vents 87, 94, 98, 114, and 116 can be adjusted to affect volume and velocity of the air flow in the forming head 20. For example, the vents may include doors, louvers, and the like that may be closed, partially opened, or fully opened to adjust the volume and velocity of air flow. The doors and louvers may be moved by microprocessor- or similarly-controlled actuators. The microprocessor or other control may receive air stream velocity and volume information from sensors located in the forming head 20. Also, in the illustrated embodiment, the suction air stream 172 is independent from air streams 34 and 54.

In embodiments described, fiber is introduced substantially across the width of the forming wire or web (which generally matches the width of the forming head). Mechanisms other than those shown that introduce fiber to the forming head (and, therefore, onto the forming wire) in this manner may be used.

Figure 5:
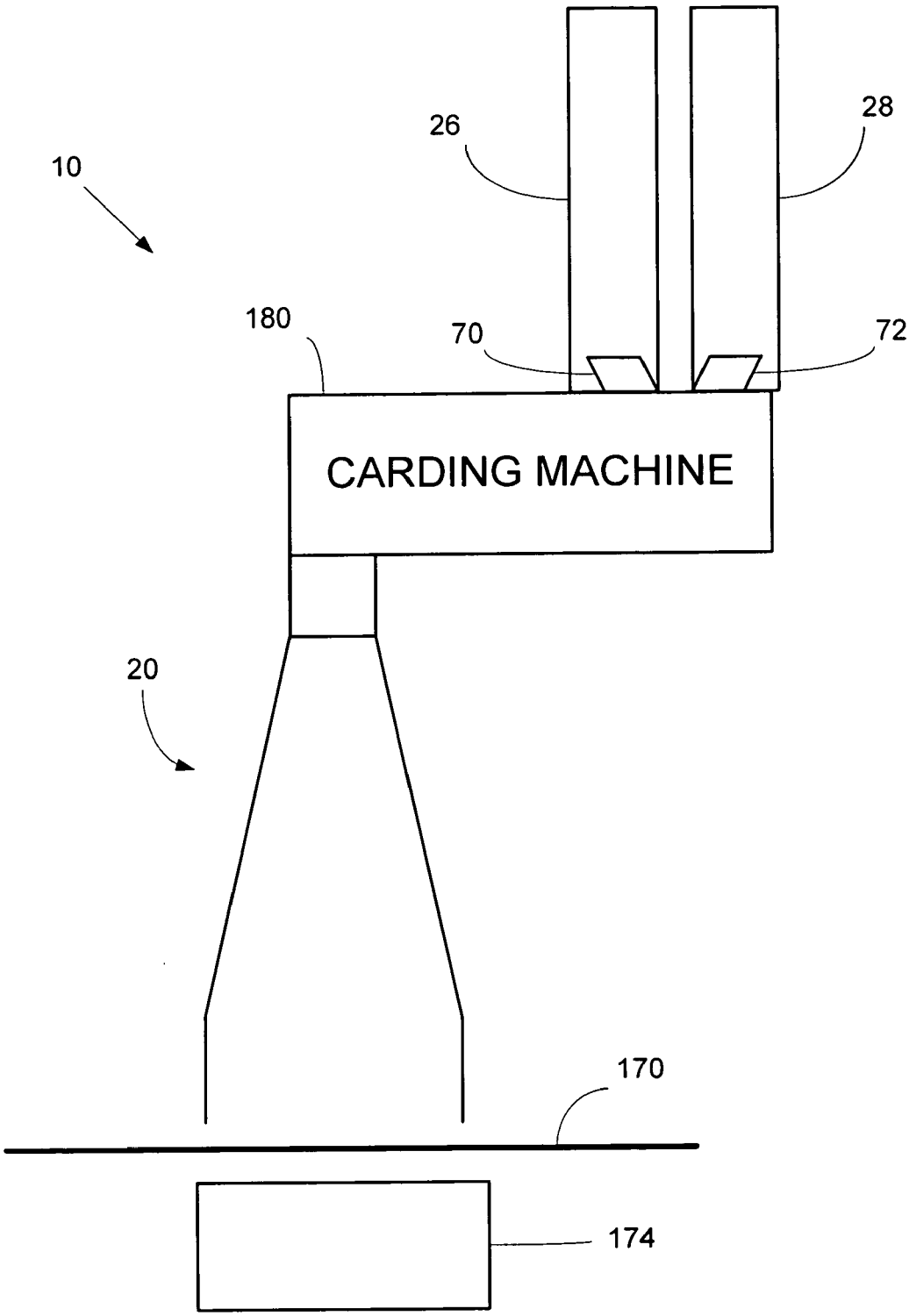
FIG. 5 is an illustration of an alternative embodiment having a carding machine.

FIG. 5 illustrates an alternative embodiment of the device 10 that includes a pre-opening device, such as a carding machine 180. The carding machine 180 is an additional component, but still introduces fiber into the forming head 20 in the manner described in the prior paragraph. The carding machine 180 may be configured or positioned in a manner to receive fibers from the metering assemblies 70 and 72 (or alternatively, from the reservoirs 26 and 28) and to deliver fibers to the forming head 20. The carding machine opens the fibers it receives and orients them in a single direction. Webs formed with carding machines tend to exhibit a high strength in the direction of fiber orientation, but weakness in other directions. The forming head 20 tends to reorient the fibers randomly to provide a web of more uniform or multi-directional strength. Opening the fibers and orienting them in a first direction can help increase the effectiveness of the randomizing action of the forming head 20.

In some embodiments of the invention, the humidity of air introduced into the forming head as well as the humidity of the air used to transport fibers to the reservoirs 26 and 28 may be controlled. (Too little humidity can cause a build up of static electricity and static attraction between fibers.) For example, humidifiers may be connected to the ducting used to transport the fibers to the reservoirs 26 and 28. The humidity in the ducting may be monitored (using a control system having sensors and a processor) and the output of the humidifier controlled (using commands from the processor) to adjust the humidity in the ducting. In addition, air from humidity-controlled sources may be delivered through ducting or conduits to the vents in the forming head (such as vents 94, 98, 114, and 116) to ensure proper humidity in the forming head.

Thus, embodiments of the invention provide, among other things, devices and methods for depositing fibers on a forming wire. Various features and advantages of the invention are set forth in the following claims.

What is claimed is:

1. A device for depositing fibers on a forming wire, the device comprising:

a fiber meter configured to deliver fiber to a forming head via a mechanical action that is substantially independent of an air flow and substantially along an entire width of a forming head; and a forming head positioned to receive fiber from the fiber meter, including one or more agitators and one or more air inlets, and configured to interface with a vacuum source used to draw air into the forming head through the one or more air inlets and such that a moderate negative pressure exists in the forming head where fibers are first introduced from the fiber meter, the one or more air inlets configured to affect the volume and velocity of air drawn into the forming head, wherein the forming head has a first width and the fiber meter has a second width that is substantially the same as the first width of the forming head.

2. A device as claimed in claim 1, further comprising a fiber reservoir from which fiber is drawn by the fiber meter into the forming head.

3. A device as claimed in claim 2, wherein a fiber pre-opening device, such as a carding machine is positioned between the fiber reservoir and the forming head.

4. A device as claimed in claim 1, wherein the forming head includes a first retention section having a plurality of agitators.

5. A device for depositing fibers on a forming wire, the device comprising:

a fiber meter configured to deliver fiber to a forming head via a mechanical action that is substantially independent of an air flow and substantially along an entire width of a forming head; and a forming head positioned to receive fiber from the fiber meter, including one or more agitators and one or more air inlets, and configured to interface with a vacuum source used to draw air into the forming head through the one or more air inlets and such that a moderate negative pressure exists in the forming head where fibers are first introduced from the fiber meter, the one or more air inlets configured to affect the volume and velocity of air drawn into the forming head, wherein the forming head has first and second angled side walls.

6. A device as claimed in claim 5, wherein the forming head includes a first retention section having a plurality of agitators.

7. A device as claimed in claim 6, wherein the forming head includes a funnel section positioned below the retention section and having a plurality of agitators.

8. A device as claimed in claim 7, wherein the forming head includes a second retention section having a plurality of agitators.

9. A device as claimed in claim 8, wherein the forming head includes a distribution section having a plurality of agitators.

10. A device as claimed in claim 5, further comprising a fiber reservoir from which fiber is drawn by the fiber meter into the forming head.

11. A device for depositing fibers on a forming surface, the device comprising:

a first fiber reservoir having an inlet to receive fiber material, and an outlet configured to pass fiber;

a fiber meter configured to supply fiber to a forming head from the first fiber reservoir without requiring the use of an air stream; and a forming head positioned adjacent to the first fiber meter, including one or more agitators, one or more air inlets, and configured to deposit fibers on a forming surface substantially via an air stream that originates from the one of more air inlets in the forming head, wherein the fiber meter is configured to generate a curtain of fiber along substantially the entire width of the forming head.

12. A device as claimed in claim 11, wherein the forming head has a first width and the fiber meter has a second width substantially the same as the first width.

13. A device as claimed in claim 11, further comprising a second fiber reservoir located adjacent to the first fiber reservoir, and one or more vents located between the first and second fiber reservoirs.

14. A device as claimed in claim 11, wherein the forming head includes a first retention section having a plurality of agitators.

15. A device as claimed in claim 14, wherein the forming head includes a funnel section positioned below the retention section and having a plurality of agitators.

16. A device as claimed in claim 15, wherein the forming head includes a second retention section having a plurality of agitators.

17. A device as claimed in claim 16, wherein the forming head includes first and second angled walls.

18. A device as claimed in claim 16, wherein the one or more inlets include louvers or doors.

19. A device for depositing fibers on a forming surface, the device comprising:

a first fiber reservoir having an inlet to receive fiber material, and an outlet configured to pass fiber;

a fiber meter configured to supply fiber to a forming head from the first fiber reservoir without requiring the use of an air stream; and a forming head positioned adjacent to the first fiber meter, including one or more agitators, one or more air inlets, and configured to deposit fibers on a forming surface substantially via an air stream that originates from the one of more air inlets in the forming head, wherein the forming head includes a first retention section having a plurality of agitators;

wherein the forming head includes a funnel section positioned below the retention section and having a plurality of agitators;

wherein the forming head includes a second retention section having a plurality of agitators; and wherein the forming head includes a distribution section having a plurality of agitators.

20. A device for depositing fibers on a forming web, the device comprising:

a first fiber reservoir having an inlet and an outlet;

a first fiber meter positioned adjacent to the outlet of the first fiber reservoir;

a second fiber reservoir having an inlet and an outlet, the second fiber reservoir positioned adjacent to the first fiber reservoir;

a second fiber meter positioned adjacent to the outlet of the second fiber reservoir; and a forming head positioned under the first fiber reservoir and the second fiber reservoir, the forming head including a first retention section;

a first angled side wall and a second angled side wall;

a funnel section positioned below the first retention section and between the first and second angled side walls;

a second retention section positioned below the funnel section;

a distribution section positioned below the second retention section; and an outlet positioned below the distribution section and configured to interface with a vacuum source such that an air stream flows from a source that is independent of any air stream used to provide fibers to the first and second fiber reservoirs toward the outlet.

21. A device as claimed in claim 20, wherein a fiber meter has a width substantially the same as a width of the forming head.

22. A device as claimed in claim 21, further comprising a first brush roll positioned adjacent to the first fiber meter.

23. A device as claimed in claim 22, further comprising a second brush roll positioned adjacent to the second fiber meter.

24. A device as claimed in claim 20, where the source that is independent of any air stream used to provide fibers to the first and second fiber reservoirs includes air provided through an inlet located in the first retention section.

25. A device as claimed in claim 20, where the source that is independent of any air stream used to provide fibers to the first and second fiber reservoirs includes air provided through one or more inlets located in the first angled side wall, the second angled side wall, or both.

26. A device as claimed in claim 20, where the source that is independent of any air stream used to provide fibers to the first and second fiber reservoirs includes air provided through an inlet located between the first and second fiber reservoirs.

27. A device as claimed in claim 20, wherein the first retention section includes a plurality of agitators configured to inhibit the flow of fiber through the forming head and enhance fiber blending and opening action of agitators.

28. A device as claimed in claim 27, wherein the funnel section includes a plurality of agitators configured to direct fibers toward the center of the forming head.

29. A device as claimed in claim 27, wherein the second retention section includes a plurality of agitators configured to inhibit the flow of fiber through the forming head and enhance fiber blending and opening action of agitators.

30. A device as claimed in claim 27, wherein the distribution section includes a plurality of agitators configured to open and direct fibers along a cross section of the forming head.

31. A forming head for depositing fibers on a forming wire, the forming head comprising:

a first retention section having a first side wall and a second side wall, the first wall having a first air inlet and the second wall having a second air inlet;

a funnel section positioned below the first retention section;

a second retention section positioned below the funnel section;

a distribution section positioned below the second retention section; and an outlet configured to interface with a vacuum source such that an air stream flows from one or both of the first and second air inlets in the first and second walls of the first retention section toward the outlet.

32. A forming head for depositing fibers on a forming wire, the forming head comprising:

a first retention section having a first side wall and a second side wall, the first wall having an air inlet and the second wall having an air inlet;

a funnel section positioned below the first retention section and between the first and second angled side walls;

a second retention section positioned below the funnel section;

a distribution section positioned below the second retention section; and an outlet configured to communicate with a vacuum source such that an air stream flows from one or both of the air inlets in the first and second walls of the first retention section toward the outlet.

33. A forming head as claimed in claim 32, further comprising a first angled side wall and a second angled side wall.

* * * * *

UNITED STATES PATENT AND TRADEMARK OFFICE

CERTIFICATE OF CORRECTION

PATENT NO. : 7,627,933 B2
APPLICATION NO. : 11/296125
DATED : December 8, 2009
INVENTOR(S) : Drapela et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1020 days.

Signed and Sealed this

Second Day of November, 2010

David J. Kappos

David J. Kappos
*Director of the United States Patent and Trademark Office*